US007545105B2

(12) United States Patent
Cheng et al.

(10) Patent No.: US 7,545,105 B2
(45) Date of Patent: Jun. 9, 2009

(54) DRIVING CIRCUIT FOR PIEZOELECTRIC LAMPS

(75) Inventors: Ying-Chang Cheng, Taipei Hsien (TW); Chin-Biau Chung, Taipei Hsien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 0 days.

(21) Appl. No.: 11/889,551

(22) Filed: Aug. 14, 2007

(65) Prior Publication Data

US 2009/0045755 A1 Feb. 19, 2009

(51) Int. Cl.
*H05B 39/04* (2006.01)

(52) U.S. Cl. ..... 315/291; 315/307; 315/177; 315/209 R

(58) Field of Classification Search ..... 315/177, 315/209 R, 291, 307
See application file for complete search history.

(56) References Cited

U.S. PATENT DOCUMENTS 6,239,558 B1 * 5/2001 Fujimura et al. ..... 315/307
7,265,502 B1 * 9/2007 Chou et al. ..... 315/291
2007/0103090 A1 * 5/2007 Cheng et al. ..... 315/209 PZ

FOREIGN PATENT DOCUMENTS

TW 1266277 B 11/2006

* cited by examiner

*Primary Examiner*—Douglas W Owens
*Assistant Examiner*—Jianzi Chen
(74) *Attorney, Agent, or Firm*—Muncy, Geissler, Olds & Lowe, PLLC

(57) ABSTRACT

An improved driving circuit for piezoelectric lamps includes a power switch unit and at least one piezoelectric transformer. The power switch unit is connected to a power source. ON/OFF of the power switch unit controls power amount transmitted to the piezoelectric transformer. The piezoelectric transformer transforms the power and drives at least one load. Operation of the power switch unit is controlled by a duty cycle signal generated by a pulse modulation unit. The pulse modulation unit is connected to a buffer unit which generates a time series at start time to suppress instant output of the piezoelectric transformer, thereby to improve the problem of voltage surge at the start time happened to the conventional piezoelectric transformers.

9 Claims, 4 Drawing Sheets

DRIVING CIRCUIT FOR PIEZOELECTRIC LAMPS

FIELD OF THE INVENTION

The present invention relates to an improved driving circuit for piezoelectric lamps and particularly to a control circuit to suppress start voltage of piezoelectric transformers.

BACKGROUND OF THE INVENTION

Cold cathode fluorescent lamp (CCFL) has many advantages such as higher efficiency, longer life span, lower cost and the like, thus is widely used on backlight modules of display devices, game devices, office equipments and lighting fixtures. To enable the CCFL to emit different colors of light different types of gases or fluorescent materials have to be filled in the CCFL. As a result the duty voltage of different colors of CCFL also varies. The CCFL emitting blue light (called "blue lamp" in short hereinafter) has a higher load impedance. If the voltage to actuate the blue lamp is not adequate, the lamp has a section of "dark segment" which is darker. This causes a lower luminosity or color variation in the backlight modules or devices it is adopted. To enable the blue lamp to be actuated normally, circuits adopted piezoelectric transformers to drive the CCFL have been developed in prior art. For instance R.O.C. patent No. I266277 entitled "Current control apparatus for fluorescent lamps" granted on Nov. 11, 2006 is one of them. As the impedance at the start time of the blue lamp is greater, and the piezoelectric transformer has characteristics mating the lamp impedance, the piezoelectric transformer outputs a higher instant voltage to mate the impedance. The impedance of the blue lamp decreases slightly after the blue lamp has been actuated, then the output voltage of the piezoelectric transformer drops to a regular duty voltage. FIG. 1 shows an output waveform chart of a circuit adopted in a conventional piezoelectric transformer. It indicates that the instant output voltage of the piezoelectric transformer at the start time increases rapidly. The instant voltage could be too high and trigger a protection mechanism of an inverter that supplies electric power, and cause a forced shutdown of the inverter. Moreover, impact of the excessive high voltage shortens the life span of electrodes in the blue lamp. Hence although the piezoelectric transformer can provide a sufficient voltage for the blue lamp corresponding to the impedance, it also has drawbacks such as producing an excessive high instant voltage at the start time to trigger the protection mechanism or causing damage of the electrodes in the lamp.

SUMMARY OF THE INVENTION

In view of the aforesaid problem occurred to the actuation circuit of the conventional piezoelectric lamp that generates an excessive high voltage surge at the start instant the primary object of the present invention is to provide an improved circuit to suppress the voltage surge at the start time to protect the actuation circuit and lamp.

The improved driving circuit for piezoelectric lamps according to the invention includes a power switch unit and at least one piezoelectric transformer. The power switch unit is connected to a power source. Through ON/OFF of the power switch unit, power amount transmitted to the piezoelectric transformer can be controlled. The piezoelectric transformer transforms the power to drive at least one load. Operation of the power switch unit is controlled by a duty cycle signal generated by a pulse modulation unit. The pulse modulation unit is connected to a buffer unit which receives a first reference cycle signal. The first reference cycle signal passes through the buffer unit to become a second reference cycle signal at a potential lower than the first reference cycle signal. The buffer unit forms a buffer time series such that at the start time of the driving circuit of the piezoelectric lamp the potential of the second reference cycle signal rises gradually to become the same as the first reference cycle signal. Through the potential alteration of the second reference cycle signal and the pulse modulation unit the duty cycle ratio of the duty cycle signal is changed.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
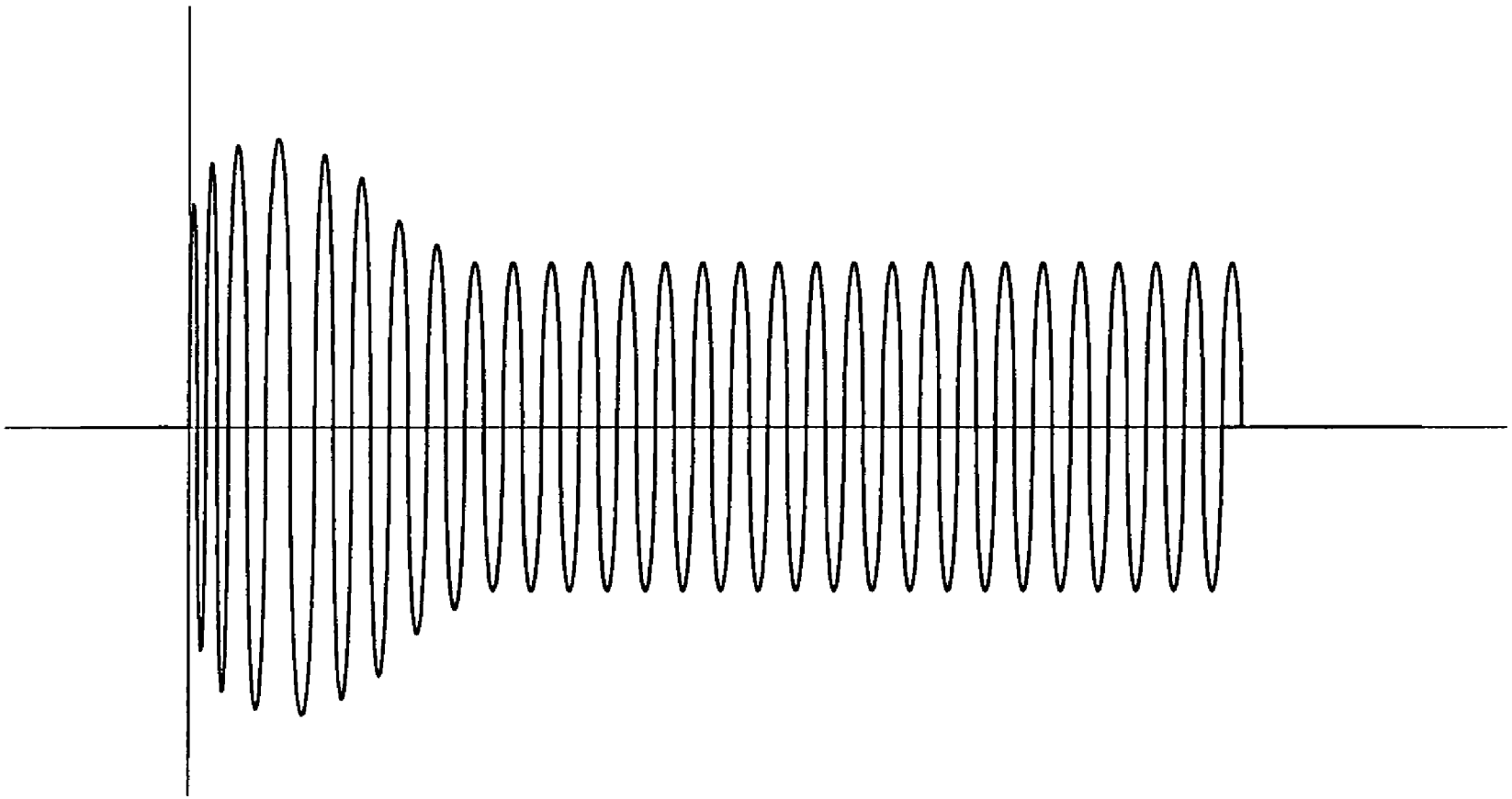
Fig. 1 PRIOR ART
FIG. 1 is an output waveform chart of a conventional piezoelectric transformer.
Figure 2:
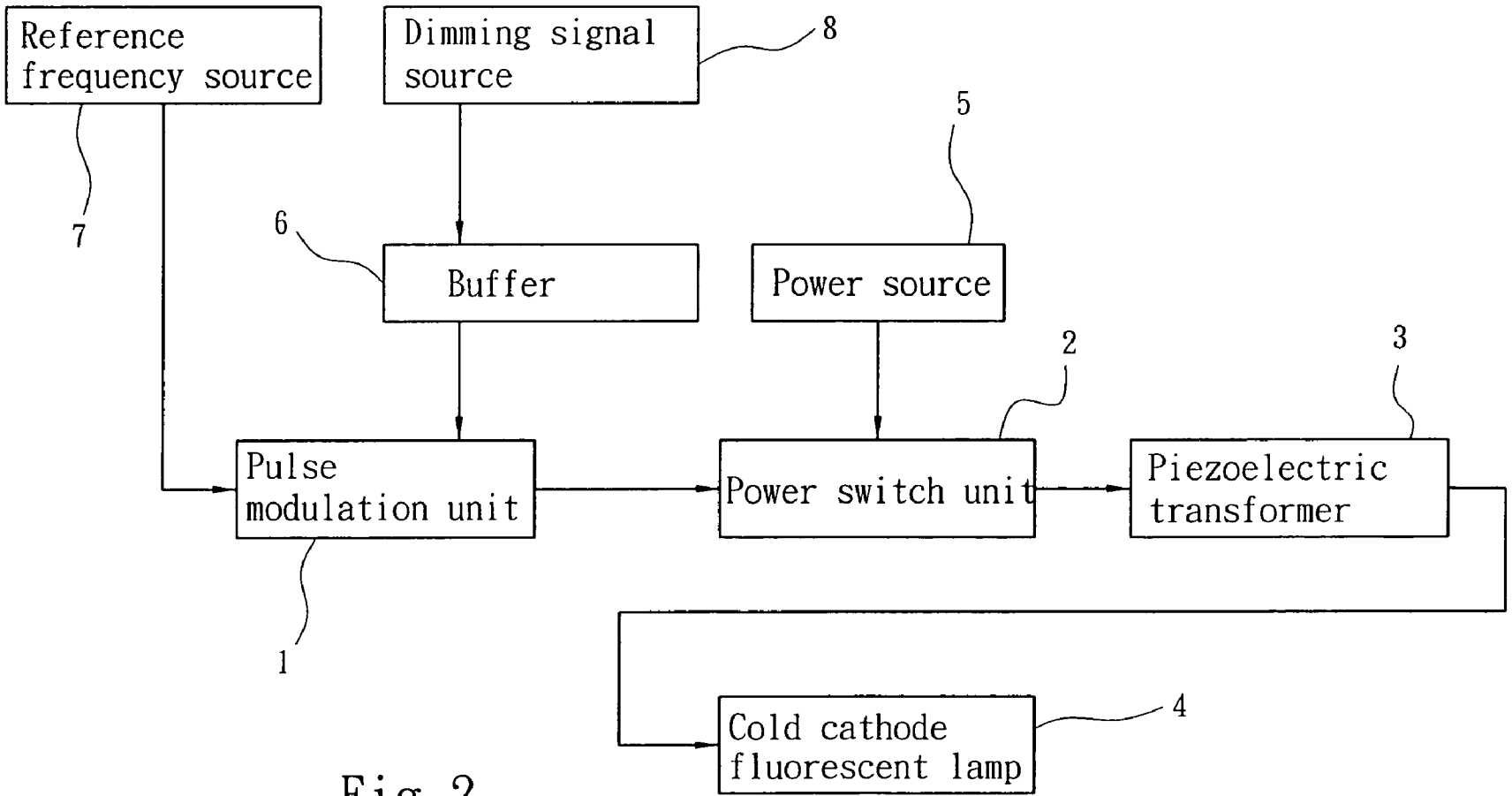
FIG. 2 is a circuit block diagram of the invention.

Please refer to FIG. 2, the improved driving circuit for piezoelectric lamps according to the invention is connected to a power source 5 and set ON/OFF through a power switch unit 2 to control power amount passing through at least one piezoelectric transformer 3. The piezoelectric transformer 3 transforms and outputs power to drive at least one load. In an embodiment of the invention the piezoelectric transformer 3 drives at least one CCFL 4. Operation of the power switch unit 2 is controlled by a duty cycle signal generated by a pulse modulation unit 1. The pulse modulation unit 1 is connected to a buffer unit 6 which receives a first reference cycle signal from a dimming signal source 8. The first reference cycle signal passes through the buffer unit 6 to become a second reference cycle signal at a potential lower that the first reference cycle signal to be transmitted to the pulse modulation unit 1. The buffer unit 6 forms a buffer time series to allow the potential of the second reference cycle signal to gradually rise and become the same as the first reference cycle signal during the buffer time series at the start time of the driving circuit of the piezoelectric lamp. Through the potential alteration of the second reference cycle signal and the pulse modulation unit 1 the duty cycle ratio of the duty cycle signal is changed. By controlling the duty cycle ratio the time ratio of power output in the same cycle can be controlled, consequentially the duty voltage of the CCFL 4 provided by the piezoelectric transformer 3 can be changed. The pulse modulation unit 1 can receive a reference frequency signal from a reference frequency source 7 to get a reference frequency to regulate the frequency of the duty cycle signal. Thus when the driving circuit of the piezoelectric lamp is actuated, although the dimming signal source 8 generates the first reference cycle signal, to avoid the piezoelectric transformer 3 from generating a voltage surge during the start time caused by the duty cycle signal regulated by the first reference cycle signal, the buffer unit 6 generates the second reference cycle signal at a potential lower than the first reference cycle signal to suppress the instant voltage at the start time of the piezoelectric transformer 3, and forms the buffer time series to make the second reference cycle signal to gradually rise at the potential of the first reference cycle signal. After the buffer time series ends, the pulse modulation unit 1 generates the duty cycle signal according to the first reference cycle signal.

Figure 3:
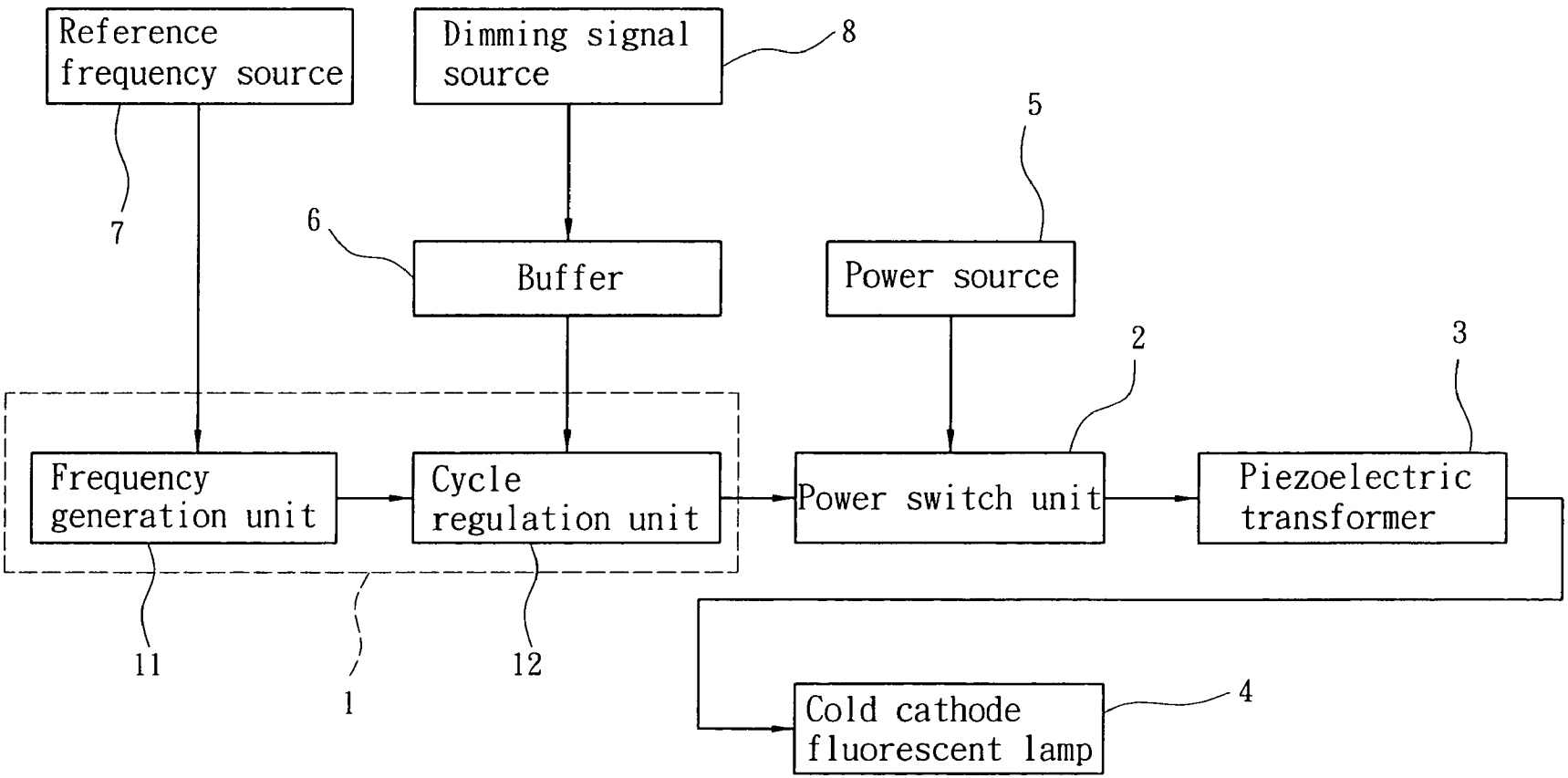
FIG. 3 is another circuit block diagram of the invention.
Figure 4:
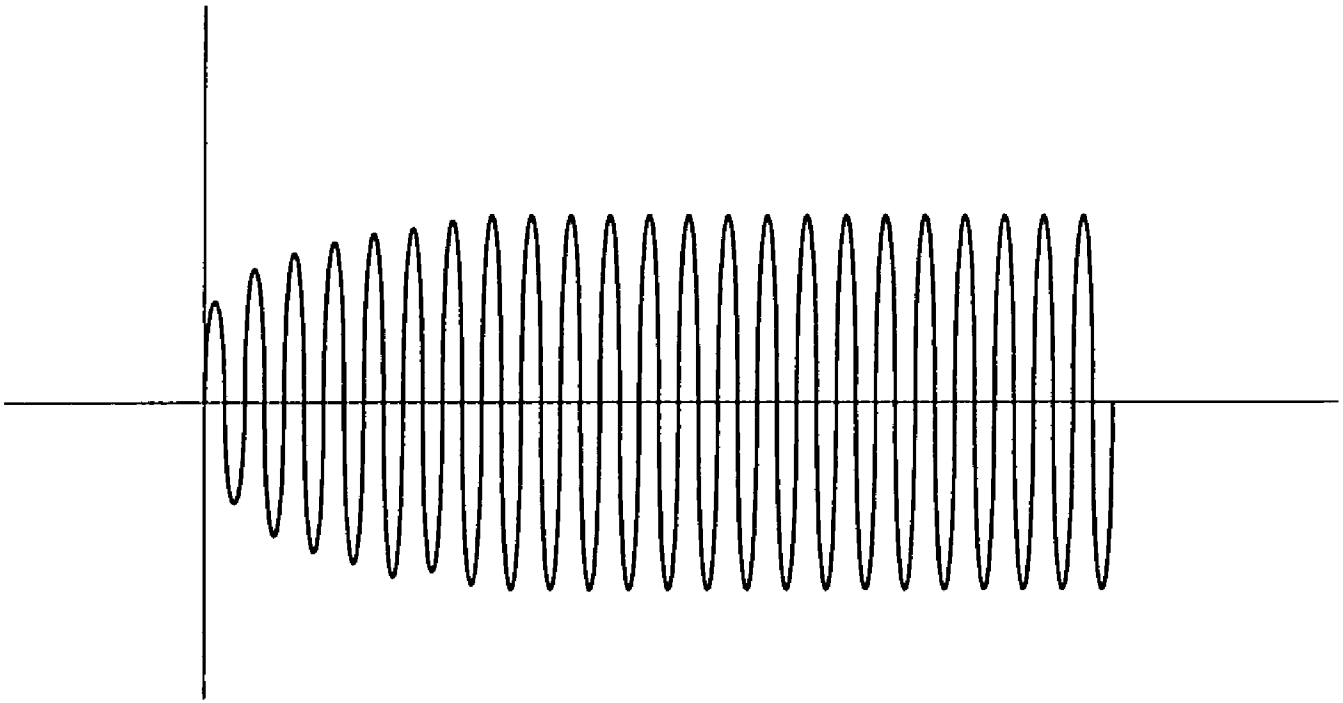
FIG. 4 is an output waveform chart of the piezoelectric transformer of the invention.

Refer to FIG. 3 for another circuit block diagram of the invention. The power amount sent by the power source 5 to the piezoelectric transformer 3 also is controlled by the power switch unit 2. The pulse modulation unit 1 includes a frequency generation unit 11 and a cycle regulation unit 12. The frequency generation unit 11 is connected to the reference frequency source 7 to get the reference frequency. The cycle regulation unit 12 is connected to the buffer unit 6 which in turn is connected to the dimming signal source 8 to get the first reference cycle signal. The buffer unit 6 generates a time series and outputs the second reference cycle signal which has a potential gradually rising at the potential of the first reference cycle signal, thereby to control the duty cycle ratio of the duty cycle signal output by the pulse modulation unit 1 at the start time. Therefore the output voltage of the piezoelectric transformer 3 is limited by the range of the duty cycle ratio, and the output voltage during start time also gradually rises according to the duty cycle ratio of the duty cycle signal (referring to FIG. 4). Thus the instant voltage output by the piezoelectric transformer 3 can be suppressed at the start time. And the phenomenon of voltage surge at the start time occurred to the conventional techniques can be improved. The buffer unit 6 may be an energy storage element having charge and discharge function. The charge and discharge time period of the buffer unit 6 may serve as the buffer time series. The energy storage element having charge and discharge function may be a capacitor. Through the voltage buffer function of the capacitor, the wave surge effect at the start time can be suppressed.

The preferred embodiments of the invention have been set forth for the purpose of illustration and disclosure, and are not the limitation of the invention. The load being driven in the invention may be a cold cathode lamp, a hot cathode lamp or a gas lamp. Modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A driving circuit for piezoelectric lamps comprising a power source, a dimming signal source to generate a first reference cycle signal, at least one piezoelectric transformer and a power switch unit to control power amount passing through the piezoelectric transformer through alteration of a duty cycle, and at least one load functioned by receiving the power transformed and output by the piezoelectric transformer, the driving circuit further including:

a pulse modulation unit to generate a duty cycle signal of the power switch unit and a buffer unit connecting to the pulse modulation unit, the first reference cycle signal being sent to the buffer unit which generates a second reference cycle signal at a potential lower than the potential of the first reference cycle signal, the potential of the second reference cycle signal output from the buffer unit gradually rising from an initial state to the potential of the first reference cycle signal to form a buffer time series, through potential alteration of the second reference cycle signal and the pulse modulation unit the duty cycle ratio of the duty cycle signal is changed.

2. The driving circuit of claim 1, wherein the buffer unit is an energy storage element capable of charging and discharging at a selected time period which becomes the buffer time series.

3. The driving circuit of claim 2, wherein the energy storage element is a capacitor.

4. The driving circuit of claim 1, wherein the pulse modulation unit is connected to a reference frequency source.

5. The driving circuit of claim 4, wherein the reference frequency source outputs a reference frequency signal to regulate the frequency of the duty cycle signal.

6. The driving circuit of claim 1, wherein the pulse modulation unit includes a frequency generation unit and a cycle regulation unit.

7. The driving circuit of claim 1, wherein the load driven by the piezoelectric transformer is a cold cathode fluorescent lamp.

8. The driving circuit of claim 1, wherein the load driven by the piezoelectric transformer is a hot cathode fluorescent lamp.

9. The driving circuit of claim 1, wherein the load driven by the piezoelectric transformer is a gas discharge lamp.

* * * * *